US011008641B2

(12) United States Patent
Unal et al.

(10) Patent No.: US 11,008,641 B2
(45) **Date of Patent: *May 18, 2021**

(54) CORROSION RESISTANT ALUMINUM ALLOYS HAVING HIGH AMOUNTS OF MAGNESIUM AND METHODS OF MAKING THE SAME

(71) Applicant: Arconic Inc., Pittsburgh, PA (US)

(72) Inventors: Ali Unal, Export, PA (US); David A. Tomes, San Antonio, TX (US); Gavin Wyatt-Mair, Lafayette, CA (US); David Timmons, Helotes, TX (US)

(73) Assignee: ARCONIC TECHNOLOGIES LLC, Pittsburgh, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/390,198

(22) Filed: Apr. 22, 2019

(65) Prior Publication Data

US 2019/0249278 A1 Aug. 15, 2019

Related U.S. Application Data

(60) Continuation of application No. 15/489,484, filed on Apr. 17, 2017, now Pat. No. 10,266,921, which is a continuation of application No. 14/591,567, filed on Jan. 7, 2015, now abandoned, which is a division of application No. 12/267,303, filed on Nov. 7, 2008, now Pat. No. 8,956,472.

(51) Int. Cl.

| | |
|---|---|
| ***C22C 21/06*** | (2006.01) |
| ***C22F 1/047*** | (2006.01) |
| ***C22C 21/08*** | (2006.01) |

(52) U.S. Cl.
CPC ..... *C22C 21/06* (2013.01); *C22C 21/08* (2013.01); *C22F 1/047* (2013.01)

(58) Field of Classification Search
CPC ..... C22C 21/06; C22C 21/08
USPC ..... 148/440, 551; 420/542
See application file for complete search history.

(56) References Cited

U.S. PATENT DOCUMENTS

| | | | | |
|---|---|---|---|---|
| 4,021,271 | A | 5/1977 | Roberts | |
| 4,626,294 | A * | 12/1986 | Sanders, Jr. | F41H 5/02 148/439 |
| 5,062,901 | A | 11/1991 | Tanaka et al. | |
| 6,248,193 | B1 | 6/2001 | Zhao et al. | |
| 2001/0025675 | A1 | 10/2001 | Haszler et al. | |
| 2010/0319817 | A1 * | 12/2010 | Norman | C22C 21/06 148/552 |

FOREIGN PATENT DOCUMENTS

| | | |
|---|---|---|
| RU | 2111826 C1 | 5/1998 |

* cited by examiner

*Primary Examiner* — George Wyszomierski
*Assistant Examiner* — Janell C Morillo
(74) *Attorney, Agent, or Firm* — Greenberg Traurig, LLP

(57) ABSTRACT

Systems and methods for continuously casting Al—Mg alloy sheet or plate product having a high amount of magnesium are disclosed. The Al—Mg products have 4 or 6 to 8 or 10 wt. % Mg and are resistant to both stress corrosion cracking and intergranular corrosion.

14 Claims, 14 Drawing Sheets

CORROSION RESISTANT ALUMINUM ALLOYS HAVING HIGH AMOUNTS OF MAGNESIUM AND METHODS OF MAKING THE SAME

RELATED APPLICATIONS

This application is a continuation of U.S. patent application Ser. No. 15/489,484 filed on Apr. 17, 2017, U.S. Pat. No. 10,266,921, which is a continuation of U.S. patent application Ser. No. 14/591,567 filed Jan. 7, 2015, which is a division of U.S. patent application Ser. No. 12/267,303 filed Nov. 7, 2008, now U.S. Pat. No. 8,956,472 issued Feb. 17, 2015. The contents of the above applications are all incorporated by reference as if fully set forth herein in their entirety.

BACKGROUND

Aluminum alloys that contain high levels of magnesium are known to have high strength. However, aluminum alloys having high levels of magnesium are also known to be susceptible to intergranular corrosion (IGC) and stress corrosion cracking (SCC).

SUMMARY OF THE DISCLOSURE

Broadly, the instant disclosure relates to corrosion resistant high-magnesium aluminum alloys, and methods of making the same. In one aspect, a continuously cast Al—Mg alloy sheet or plate product is provided, which includes 4 or 6-9 or 10 wt. % Mg and is resistant to both (i) stress corrosion cracking and (ii) intergranular corrosion. In one embodiment, the Al—Mg alloy comprises a plurality of grains, which have grain boundaries, and the Al—Mg alloy is substantially free of a continuous film of β-phase at the grain boundaries after the Al—Mg alloy has been age sensitized. In one embodiment, the grains of the Al—Mg alloy comprise $Mg_2Si$ precipitates.

In another aspect, methods of producing corrosion resistant high-magnesium aluminum alloys are provided. In one approach, a method includes (a) continuously casting an Al—Mg alloy comprising from about 6 wt. % to about 10 wt. % Mg, (b) hot rolling the Al—Mg alloy to a thickness of less than 6.35 mm, and (c) annealing the Al—Mg alloy via a furnace. In this approach, the annealing step comprises (i) heating the Al—Mg alloy at elevated temperature and for a time sufficient to achieve an O temper; and (ii) cooling the Al—Mg alloy. In this approach, after the cooling step, the Al—Mg alloy comprises a plurality of grains, and the Al—Mg alloy is substantially free of a continuous film of β-phase at the grain boundaries after the Al—Mg alloy has been age sensitized. In one embodiment, after the cooling step (c)(ii), the Al—Mg alloy is free of a continuous film of β-phase. In one embodiment, the heating step (c)(i) comprises heating the Al—Mg alloy to a temperature T1, wherein T1 is from about 365° C. to about 500° C., for a period of at least about 2 hours. In one embodiment, the cooling step (c)(ii) comprises first cooling the Al—Mg alloy from the temperature T1 to a temperature T2, wherein the temperature T2 is at least about 25° C. less than the temperature T1, and wherein the rate of cooling from temperature T1 to temperature T2 is not greater than about 100° C. per hour, and second cooling the Al—Mg alloy from the temperature T2 to a temperature T3, wherein T3 is at least about 100° C. less than temperature T2. In some versions of this embodiment, the cooling rate of the first cooling step is in the range of from about 30° C./hour to about 60° C./hour. In one embodiment, the cooling rate of the second cooling step is at least about 100° C./hour. In one embodiment, the continuously casting step comprises strip casting.

Various ones of the novel and inventive aspects noted hereinabove may be combined to yield various corrosion resistant high-magnesium aluminum alloy. These and other aspects, advantages, and novel features of the disclosure are set forth in part in the description that follows and will become apparent to those skilled in the art upon examination of the following description and figures, or may be learned by practicing the disclosure.

DETAILED DESCRIPTION

Figure 1:
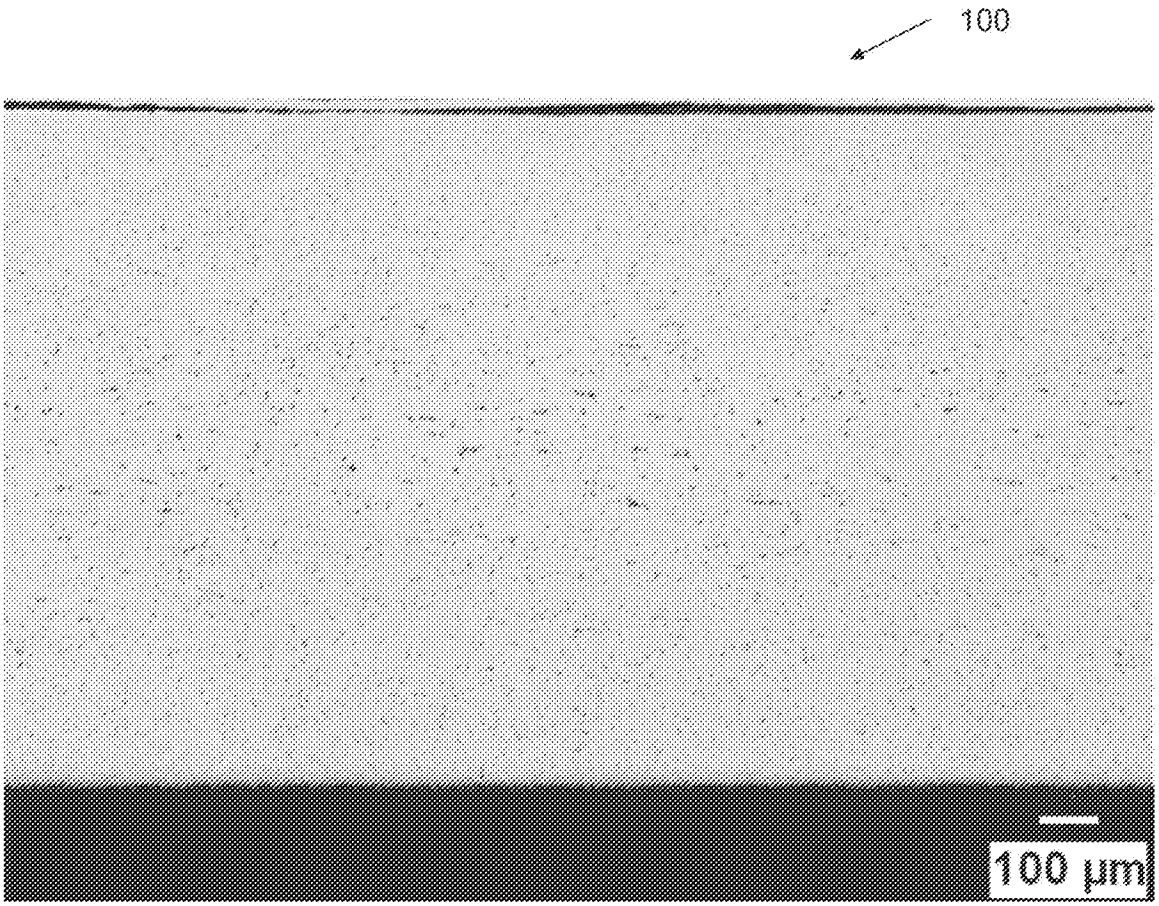
FIG. 1 is a micrograph of one embodiment of a high-Mg rolled aluminum alloy product produced via a strip casting process.

The instant disclosure relates to rolled aluminum alloy products having a high amount of magnesium and produced by a continuous casting process. The aluminum alloy products generally include at least about 4.5 wt. % magnesium, or at least about 6 wt. % magnesium, are produced via a continuous casting process, such as strip casting or slab casting, and are resistant to stress corrosion cracking and intergranular corrosion. Aluminum alloy products produced via a continuous casting process, having high amounts of magnesium, and being resistant to stress corrosion cracking and intergranular corrosion have heretofore been unknown due to, for example, magnesium bleed out and slab cracking.

The aluminum alloy products may be any rolled aluminum alloy product having a high amount of magnesium, such as those falling into the class of alloys generally categorized as 5XXX series aluminum alloys. In one embodiment, the aluminum alloy products include at least about 4.5 wt. % Mg. In other embodiments, the aluminum alloy products include higher amounts of magnesium, such as at least about 6.0 wt. % Mg, or even at least about 6.1 wt. % Mg, or at least about 6.3 wt. % Mg, or even at least about 6.5 wt. % Mg. In one embodiment, the aluminum alloy products include not greater than about 10 wt. % Mg, such as not greater than 9.5 wt. % Mg, or not greater than about 9.0 wt. % Mg, or not greater than about 8.5 wt. % Mg.

Other elements may be included in the aluminum alloy in non-incidental amounts. For example, the aluminum alloy may include up to 0.8 wt. % copper, up to 1.2 wt. % manganese, up to 0.5 wt. % chrome, up to 1.0 wt. % zinc, and up to 0.3 wt. % Zr, to name a few. When the aluminum alloy products are produced via slab casting, the aluminum alloy generally includes non-incidental amounts of beryllium, such as at least about 0.0003 wt. % beryllium. The aluminum alloy may include small amounts of incidental elements and impurities. For example, trace amounts of iron and silicon may be included in the aluminum alloy. Iron may be included in the aluminum alloy in an amount of up to 0.15 wt. %. Silicon may be included in the aluminum alloy in an amount that will allow for the precipitation of $Mg_2Si$ phase during solidification. The actual amount of Si required for this purpose will depend on the Fe content of the metal and cooling rate applied in solidification. In other embodiments, silicon may be included in the aluminum alloy as an alloying ingredient.

The rolled aluminum alloy products are resistant to stress corrosion cracking. "Resistant to stress corrosion cracking" means that, both before and after the aluminum alloy product has been age sensitized, the aluminum alloy product passes ASTM Standard G44-88, entitled "Standard Practice for Evaluating Stress Corrosion Cracking Resistance of Metals and Alloys by Alternate Immersion in 3.5% Sodium Chloride" with the aluminum alloy being stressed to at least 75% of its tensile yield strength in the L-T direction. "Age sensitized" means that the aluminum alloy product has been artificially aged to a condition representative of at least 20 years of service life. For example, the aluminum alloy product may be continuously exposed to elevated temperature for several days (e.g., a temperature in the range of about 100° C.-120° C. for a period of about 7 days).

The rolled aluminum alloy products are also resistant to intergranular corrosion. "Resistant to intergranular corrosion" means that, both before and after the Al—Mg alloy has been age sensitized, the aluminum alloy product passes ASTM Standard G67-86, entitled "Standard Test Method for Determining the Susceptibility to Intergranular Corrosion of 5XXX Series Aluminum Alloys by Mass Loss After Exposure to Nitric Acid (NAMLT Test). If the measured mass loss per ASTM G67-86 is not greater than 15 mg/cm$^2$, then the sample is considered not susceptible to intergranular corrosion. If the mass loss is at least about than 25 mg/cm$^2$, then the sample is considered susceptible to intergranular corrosion. If the measured mass loss is between 15 mg/cm$^2$ and 25 mg/cm$^2$, then further checks are conducted by microscopy to determine the type and depth of attack, whereupon one skilled in the art may determine whether there is intergranular corrosion via the microscopy results.

The rolled aluminum alloy products are produced via a continuous casting process. A continuous casting process is one in which a slab or strip is made continuously from molten metal without interruption, as described in further detail below. Continuous casting does not include ingot casting processes, such as direct chill casting, or electromagnetic casting processes, which are considered semi-continuous casting processes.

The aluminum alloy products are rolled aluminum alloy products, and may be in the form of sheet or plate. A sheet product is a rolled aluminum alloy product having a thickness greater than that of aluminum foil (e.g., at least 0.008 inch or 0.2 mm), but less than the thickness of aluminum plate (e.g., not greater than 0.249 inch). A plate product is a rolled aluminum alloy product having a thickness of at least about 0.250 inch. The rolled aluminum products are produced from a continuous casting process.

As noted, the aluminum alloy products are produced via either strip casting or slab casting. One embodiment of a strip cast aluminum alloy product 100 is illustrated in FIG. 1. The strip cast aluminum alloy product of FIG. 1 includes about 6.4 wt. % Mg and about 0.4 wt. Zn. The rolled product of FIG. 1 is characterized by fine microstructures and a lower population of particles in the center band compared to the outer zones.

Figure 2:
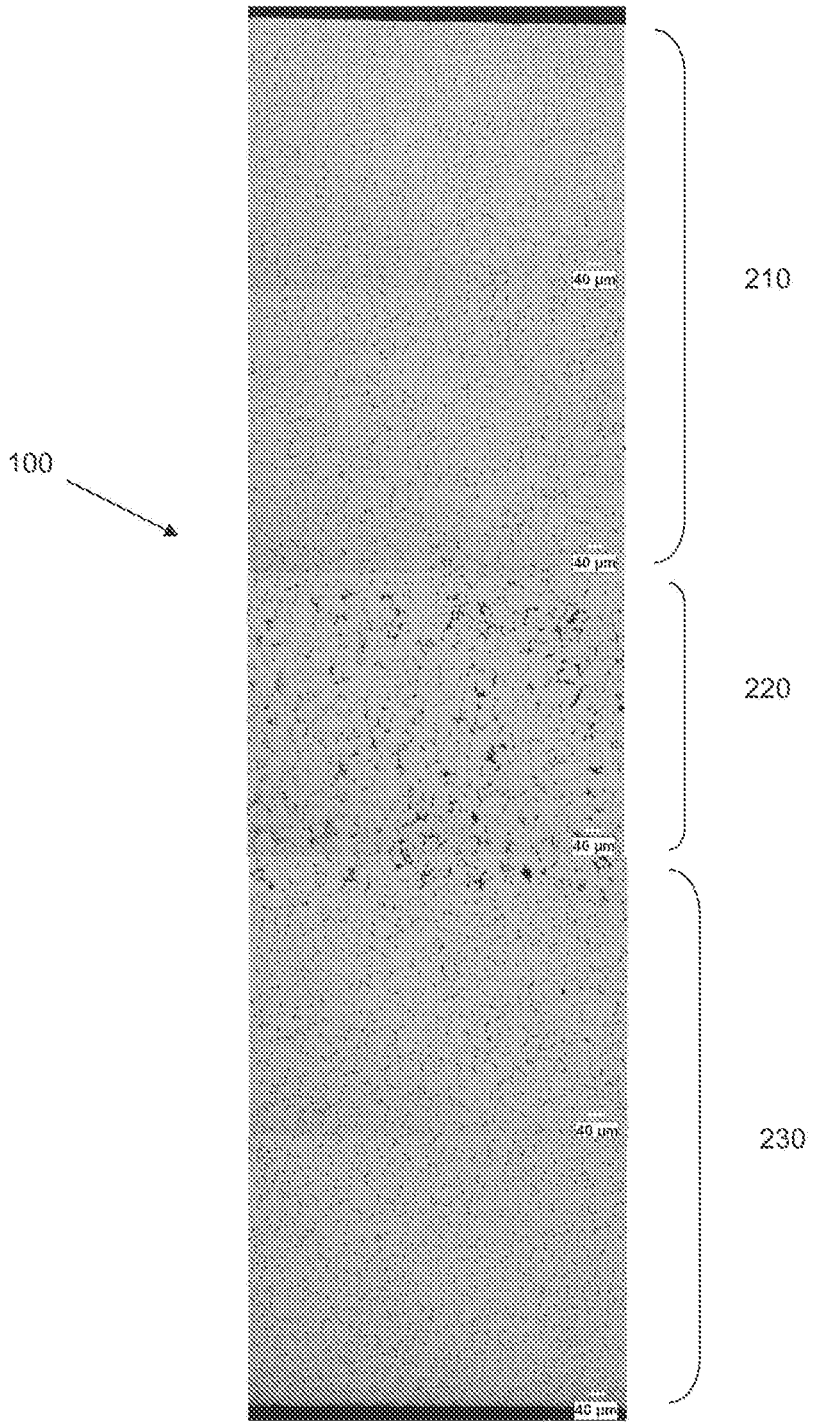
FIG. 2 is a collage of micrographs representing the as-cast strip of a high-Mg aluminum alloy.

Referring now to FIG. 2, the structure of the product 100 is transmitted from the cast strip, which generally manifests as an upper shell 210, a lower shell 230 and a center zone 220 in the as-cast state as illustrated in FIG. 2. The upper shell 210 and lower shell 230 include equiaxed dendritic grains. The center zone 220 includes globular grains and eutectic between the grains. The strip product 100 is further characterized by fine microstructures and the absence of intermetallic particle stringers in the center zone.

The aluminum alloy products may realize resistance to stress corrosion cracking and intergranular corrosion as a result of, at least in part, due to the absence of a continuous film of β-phase at the grain boundaries and/or via the $Mg_2Si$ precipitates of the aluminum. Aluminum alloy products are polycrystalline. A "grain" is a crystal of the polycrystalline structure of the aluminum alloy, and "grain boundaries" are the boundaries that connect the grains of the of the polycrystalline structure of the aluminum alloy. "β-phase" is $Al_3Mg_2$ or $Al_8Mg_5$, and "a continuous film of β-phase" means that a continuous volume of β-phase is present at the majority of the grain boundaries. The continuity of the β-phase may be determined, for example, via microscopy at a suitable resolution (e.g., a magnification of at least 200×). "$Mg_2Si$ precipitates" means the $Mg_2Si$ constituents that form within the aluminum alloy as a result of an anneal process, aging process or an age sensitizing process. The $Mg_2Si$ precipitates are located within or at the grain boundaries of at least some of the grains of the aluminum alloy. In one embodiment, at least 0.05 volume percent of the aluminum alloy comprises $Mg_2Si$ precipitates as determined via a micrograph at a suitable resolution.

Figure 3:
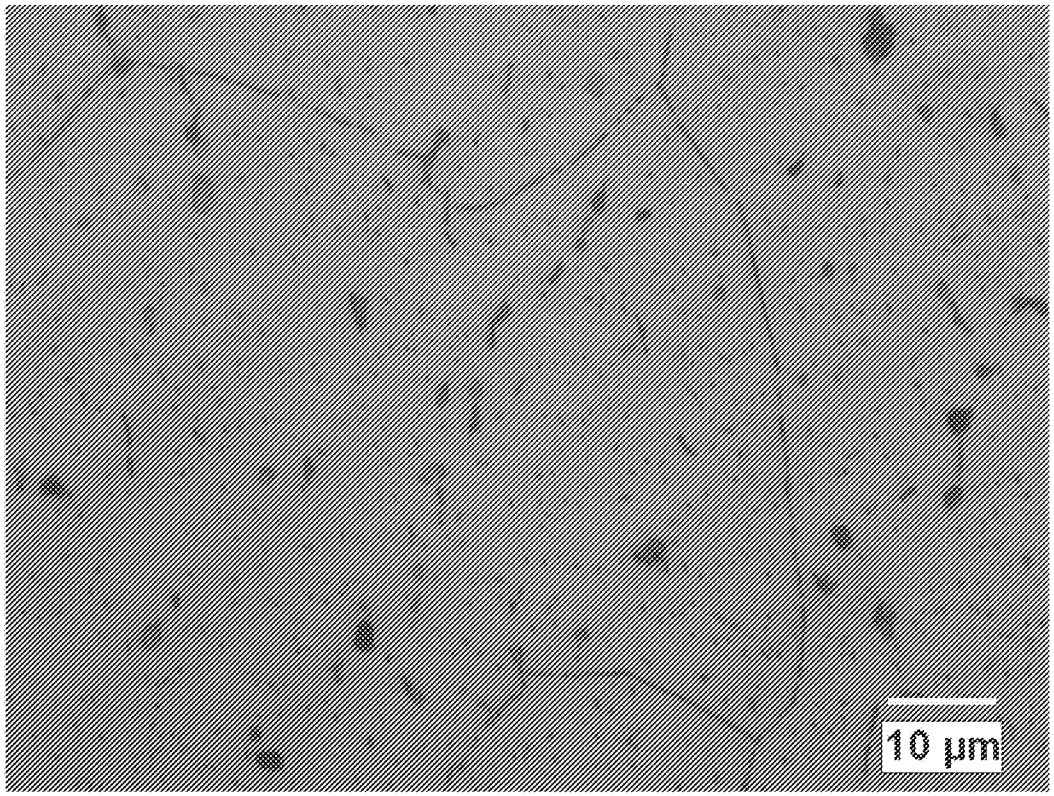
FIG. 3 is a micrograph of a high-Mg rolled aluminum alloy product that is substantially free of a continuous volume of n-phase at the majority of the grain boundaries.

One embodiment of an aluminum alloy product having high Mg and that is substantially free of a continuous volume of β-phase at the majority of the grain boundaries is illustrated in FIG. 3. In the illustrated embodiment, the alloy contained about 6.4 wt. % Mg and was produced via a continuous strip casting process. The alloy was processed in accordance with the teachings herein (e.g., first cooled at rate of 80° F./hour after a furnace anneal at 850° F. for 4 hours). As illustrated, the high-Mg alloy realizes discontinuities in the grain boundary precipitates and more extensive precipitation within grains.

Some mechanical properties of the high-Mg alloys are provided in the below table.

| Alloy | UTS (ksi) | TYS (ksi) | El (%) | Composition (wt. %) |
|---|---|---|---|---|
| A | 46.5 | 20.2 | 23.0 | Al—6.4Mg—0.5Zn—0.23Si—0.17Fe |
| H | 49.2 | 22.2 | 25.3 | Al—7.96Mg—0.032Zn—0.14Si—0.011Fe |

Alloys A and H were processed in accordance with the teachings herein. Testing was completed in the L (longitudinal) direction on samples of 1 mm thickness after age sensitizing.

The aluminum alloy products of the instant disclosure may be utilized in a variety of applications, such as those requiring high strength. In one embodiment, the aluminum alloy products are utilized in a vehicle part. An "vehicle" is any motorized or non-motorized land-based vehicle, such as, for example, passenger vehicles (e.g., cars and trucks), warfare vehicles (e.g., tanks), railroad cars, bicycles, and industrial vehicles (e.g., forklifts, backhoe), to name a few. A "vehicle part" is any part suited to be produced from an aluminum alloy having the claimed amount of magnesium and that is useful in an vehicle, such as for example, body panels and stiffeners. In other embodiments, the aluminum alloy products may be utilized in a marine applications (e.g., any apparatus having an intended use in water), such as any water-based vehicle (e.g. boats, submarines), lighthouses, buoys and the like.

Figure 4A:
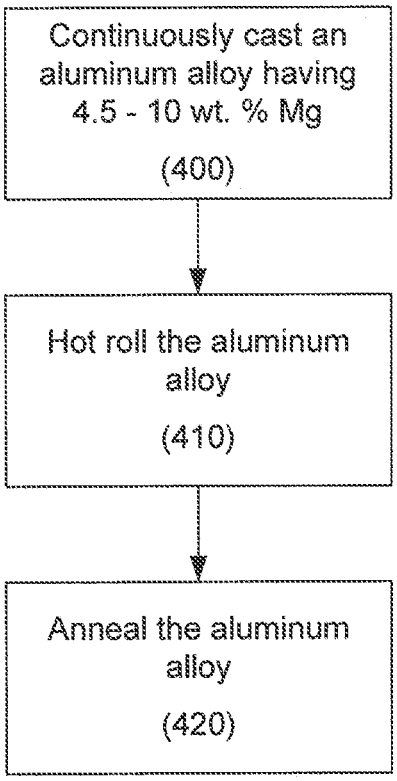
FIG. 4*a* is a flow chart illustrating one embodiment of a method for producing aluminum alloy products.

One embodiment of a method for producing rolled aluminum alloys products having a high amount of magnesium and that are resistant to stress corrosion cracking and intergranular corrosion is illustrated in FIG. 4*a*. In the illustrated embodiment, the method comprises continuously casting an aluminum alloy comprising from about 4.5 wt. % to about 10 wt. % Mg (400), hot rolling the aluminum alloy (410), and annealing the aluminum alloy via a furnace (420).

Figure 5:
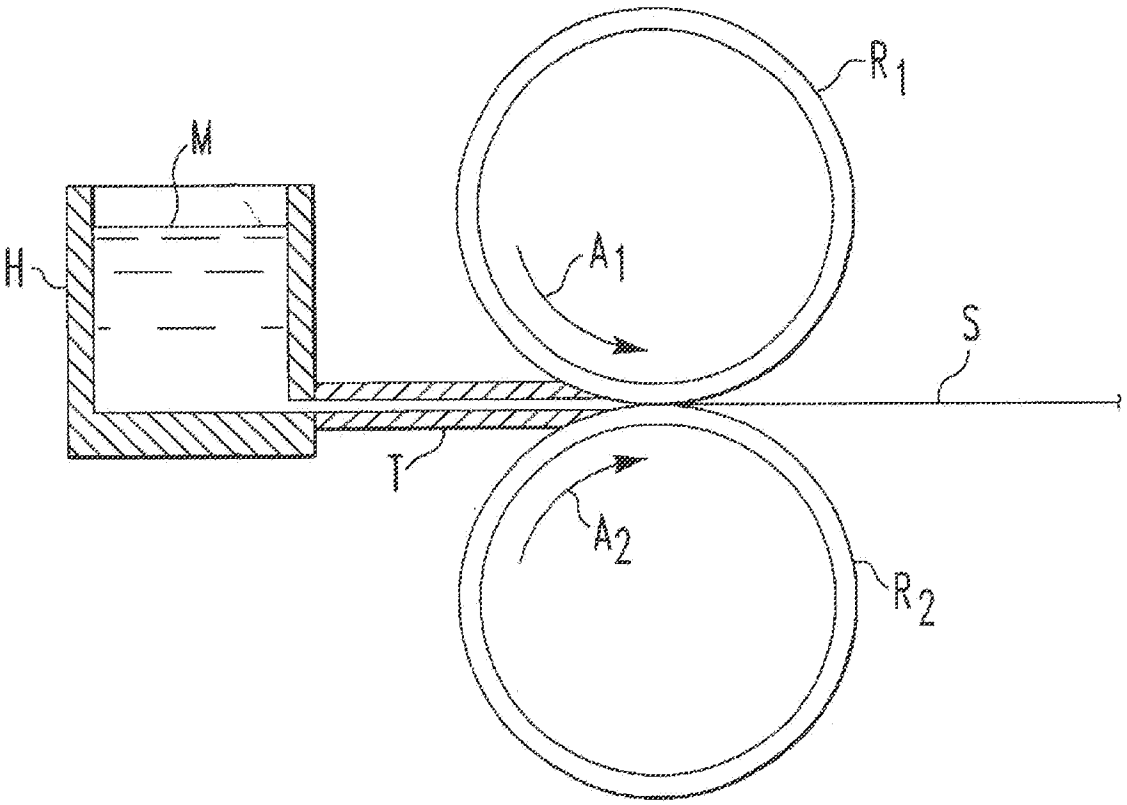
FIG. 5 is a schematic view of one embodiment of a strip casting apparatus.
Figure 6:
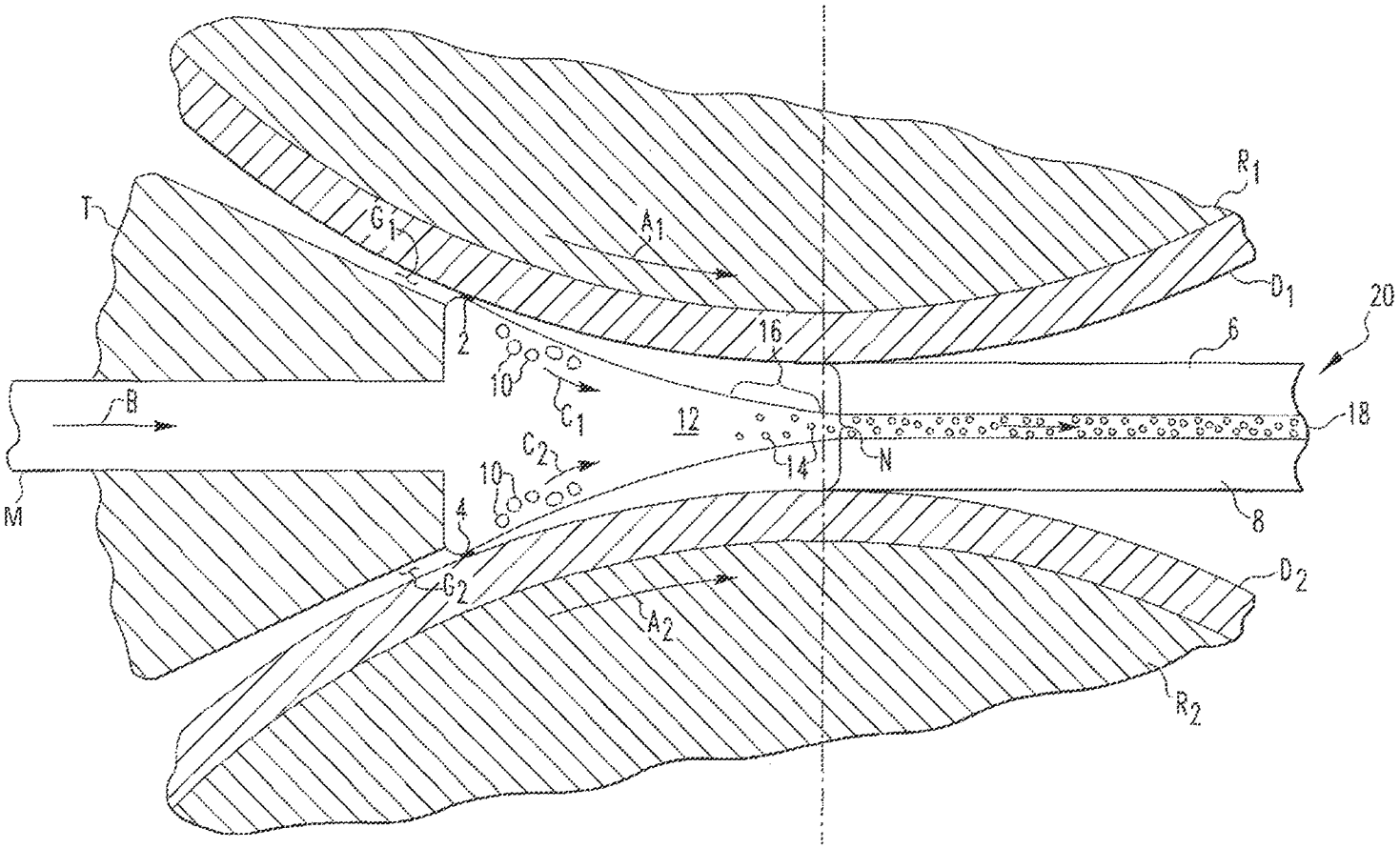
FIG. 6 is a close-up view of the strip casting apparatus of FIG. 5.

The continuous casting process is one of a strip casting or a slab casting process. One embodiment of a method for strip casting is illustrated in FIGS. 5-6. In the illustrated embodiment, a horizontal continuous strip casting apparatus is illustrated, where the strip casting may be practiced by using a pair of counter-rotating cooled rolls $R_1$ and $R_2$ rotating in the directions of the arrows $A_1$ and $A_2$, respectively. By the term horizontal, it is meant that the cast strip is produced in a horizontal orientation or at an angle of plus or minus about 30° from horizontal. As shown in more detail in FIG. 6, a feed tip T, which may be made from a ceramic material, distributes molten metal M (e.g., a molten aluminum alloy having a high amount of magnesium) in the direction of arrow B directly onto the rolls $R_1$ and $R_2$ rotating in the direction of the arrows $A_1$ and $A_2$, respectively. Gaps $G_1$ and $G_2$ between the feed tip T and the respective rolls $R_1$ and $R_2$ are maintained at a small distance to restrict molten metal from leaking out and to reduce the exposure of the molten metal to the atmosphere along the rolls $R_1$ and $R_2$ yet avoid contact between the tip T and the rolls $R_1$ and $R_2$. A suitable dimension of the gaps $G_1$ and $G_2$ is about 0.01 inch (0.25 mm). A plane L through the centerline of the rolls $R_1$ and $R_2$ passes through a region of reduced clearance between the rolls $R_1$ and $R_2$ referred to as the roll nip N.

The molten metal M directly contacts the cooled rolls $R_1$ and $R_2$ at regions 2 and 4, respectively. Upon contact with the rolls $R_1$ and $R_2$, the metal M begins to cool and solidify. The cooling metal produces an upper shell 6 of solidified metal adjacent the roll $R_1$ and a lower shell 8 of solidified metal adjacent to the roll $R_2$. The thickness of the shells 6 and 8 increases as the metal M advances towards the nip N. Large dendrites 10 of solidified metal (not shown to scale) are produced at the interfaces between each of the upper and lower shells 6 and 8 and the molten metal M. The large dendrites 10 are broken and dragged into a center portion 12 of the slower moving flow of the molten metal M and are carried in the direction of arrows $C_1$ and $C_2$. The dragging action of the flow can cause the large dendrites 10 to be broken further into smaller dendrites 14 (not shown to scale). In the central portion 12 upstream of the nip N referred to as a region 16, the metal M is semi-solid and includes a solid component (the solidified small dendrites 14) and a molten metal component. The metal M in the region 16 has a mushy consistency due in part to the dispersion of the small dendrites 14 therein. At the location of the nip N, the metal becomes substantially solid. Downstream of the nip N, the central portion 12 is a solid central layer 18 containing the small dendrites 14 sandwiched between the upper shell 6 and the lower shell 8. In the central layer 18, the small dendrites 14 may be about 20 to about 50 microns in size and have a generally globular shape.

The three layers of the upper and lower shells 6 and 8 and the solidified central layer 18 constitute a solid cast strip 20. The solid central layer 18 constitutes about 20 to about 30 percent of the total thickness of the strip 20. The molten aluminum alloy has an initial concentration of alloying elements including peritectic forming alloying elements and eutectic forming alloying elements. Alloying elements which are peritectic formers with aluminum are Ti, V, Zr and Cr. All other alloying elements are eutectic formers with aluminum, such as Si, Fe, Ni, Zn, Mg, Cu and Mn. During solidification of an aluminum alloy melt, dendrites typically have a lower concentration of eutectic formers than the surrounding mother melt and higher concentration of peritectic formers. In the region 16, in the center region upstream of the nip, the small dendrites 14 are thus partially depleted of eutectic formers while the molten metal surrounding the small dendrites is somewhat enriched in eutectic formers. Consequently, the solid central layer 18 of the strip 20, which contains a large population of dendrites, is depleted of eutectic formers (typically by up to about 20 weight percent, such as about 5 to about 20 wt. %) and is enriched in peritectic formers (typically by up to about 45 percent such, as about 5 to about 45 wt. %) in comparison to the concentration of the eutectic formers and the peritectic formers in each of the metal. M, the upper shell 6 and the lower shell 8.

The rolls $R_1$ and $R_2$ serve as heat sinks for the heat of the molten metal M. Heat is transferred from the molten metal M to the rolls $R_1$ and $R_2$ in a uniform manner to ensure uniformity in the surface of the cast strip 20. Surfaces $D_1$ and $D_2$ of the respective rolls $R_1$ and $R_2$ may be made from steel or copper and are textured and include surface irregularities (not shown) which contact the molten metal M. The surface irregularities may serve to increase the heat transfer from the surfaces $D_1$ and $D_2$ and, by imposing a controlled degree of nonuniformity in the surfaces $D_1$ and $D_2$, result in uniform heat transfer across the surfaces $D_1$ and $D_2$. The surface irregularities may be in the form of grooves, dimples, knurls or other structures and may be spaced apart in a regular pattern of about 20 to about 120 surface irregularities per inch or about 60 irregularities per inch. The surface irregularities may have a height of about 5 to about 200 microns or about 100 microns. The rolls $R_1$ and $R_2$ may be coated with a material to enhance separation of the cast strip from the rolls $R_1$ and $R_2$ such as chromium or nickel.

The control, maintenance and selection of the appropriate speed of the rolls $R_1$ and $R_2$ may impact the operability. The roll speed determines the speed that the molten metal M advances towards the nip N. If the speed is too slow, the large dendrites 10 will not experience sufficient forces to become entrained in the central portion 12 and break into the small dendrites 14. Accordingly, the disclosed strip casting methodology is suited for operation at high speeds such as about 25 to about 400 feet per minute or about 100 to about 400 feet per minute or about 150 to about 300 feet per minute. The linear speed at which molten aluminum is delivered to the rolls $R_1$ and $R_2$ may be less than the speed of the rolls $R_1$ and $R_2$ or about one quarter of the roll speed. High-speed continuous casting may be achievable in part because the textured surfaces $D_1$ and $D_2$ ensure uniform heat transfer from the molten metal M.

The roll separating force may be a parameter in practicing the strip casting. The casting speed may be adjusted to ensure that roll force is within a predetermined range, which may ensure that solidification is completed just at the nip. Excessive molten metal passing through the nip N may cause the layers of the upper and lower shells 6 and 8 and the solid central portion 18 to fall away from each other and become misaligned. Insufficient molten metal reaching the nip N causes the strip to form prematurely as occurs in conventional roll casting processes. A prematurely formed strip 20 may be deformed by the rolls $R_1$ and $R_2$ and experience centerline segregation. Suitable roll separating forces are about 25 to about 300 pounds per inch of width cast or about 100 pounds per inch of width cast. In general, slower casting speeds may be needed when casting thicker gauge aluminum alloy in order to remove the heat from the thick alloy. Unlike conventional roll casting, such slower casting speeds do not result in excessive roll separating forces in the strip casting apparatus because fully solid aluminum strip is not produced upstream of the nip.

Thin gauge aluminum strip product may be cast via conventional roll casting methods. Roll separating force has been a limiting factor in producing low gauge aluminum alloy strip product by that method, but the disclosed strip casting methodology is not so limited because the roll separating forces are orders of magnitude less than some other strip casting processes. Aluminum alloy strip may be produced at thicknesses of about 0.1 inch or less at casting speeds of 25 to about 400 feet per minute. Thicker gauge aluminum alloy strip may also be produced via strip casting, for example at a thickness of about ¼ inch.

The roll surfaces $D_1$ and $D_2$ heat up during casting and are prone to oxidation at elevated temperatures. Nonuniform oxidation of the roll surfaces during casting can change the heat transfer properties of the rolls $R_1$ and $R_2$. Hence, the roll surfaces $D_1$ and $D_2$ may be oxidized prior to use to minimize changes thereof during casting. It may be beneficial to brush the roll surfaces $D_1$ and $D_2$ from time to time or continuously to remove debris which builds up during casting of aluminum and aluminum alloys. Small pieces of the cast strip may break free from the strip S and adhere to the roll surfaces $D_1$ and $D_2$. These small pieces of aluminum alloy strip are prone to oxidation, which may result in nonuniformity in the heat transfer properties of the roll surfaces $D_1$ and $D_2$. Brushing of the roll surfaces $D_1$ and $D_2$ avoids the nonuniformity problems from debris which may collect on the roll surfaces $D_1$ and $D_2$.

Aluminum alloy strip may be continuously cast via strip casting. The aluminum alloy strip 20 includes a first layer of an aluminum alloy and a second layer of the aluminum alloy (corresponding to the shells 6 and 8) with an intermediate layer (the solidified central layer 18) therebetween. The concentration of eutectic forming alloying elements in the intermediate layer is less than in the first and second layers, typically by up to about 20 wt. % such as by about 5 to about 20%. The concentration of peritectic forming alloying elements in the intermediate layer is greater than in the first and second layers, typically by up to about 45 wt. % such as by about 5 to about 45%. The grains in the aluminum alloy strip produced via strip casting may be substantially undeformed because the force applied by the rolls is low (300 pounds per inch of width or less). The strip 20 is not solid until it reaches the nip N; hence it is not hot rolled in the manner of conventional twin roll casting and does not receive typical thereto-mechanical treatment. In the absence of conventional hot rolling in the caster, the grains in the strip 20 are substantially undeformed and retain their initial structure achieved upon solidification, i.e. an equiaxial structure, such as globular.

Continuous strip casting of aluminum alloys may be facilitated by initially selecting the desired dimension of the nip N corresponding to the desired gauge of the strip S. The speed of the rolls $R_1$ and $R_2$ is increased to a desired speed which is less than the speed which causes the roll separating force increases to a level which indicates that rolling is occurring between the rolls $R_1$ and $R_2$. Casting at the rates via the disclosed strip casting process (i.e. about 25 to about 400 feet per minute) solidifies the aluminum alloy strip about 1000 times faster than aluminum alloy cast as an ingot and improves the properties of the strip over aluminum alloys cast as an ingot.

It may be beneficial to support the hot strip S exiting the rolls $R_1$ and $R_2$ until the strip S cools sufficiently to be self-supporting. In one embodiment, a continuous conveyor belt (not illustrated) is positioned beneath the strip S exiting the rolls $R_1$ and $R_2$. The belt may travel around pulleys and supports the strip S for a distance that may be about 10 feet. The length of the belt between the pulleys may be determined by the casting process, the exit temperature of the strip S and the alloy of the strip S. Suitable materials for the belt B include fiberglass and metal (e.g. steel) in solid form or as a mesh. Alternatively, the support mechanism may include a stationary support surface (not illustrated) such as a metal shoe over which the strip S travels while it cools. The shoe may be made of a material to which the hot strip S does not readily adhere. In certain instances where the strip S is subject to breakage upon exiting the rolls $R_1$ and $R_2$, the strip S may be cooled downstream of the rolls with a fluid such as air or water. Typically, the strip S exits the rolls $R_1$ and $R_2$ at about 1100° F. It may be desirable to lower the strip temperature to about 1000° F. within about 8 to 10 inches of the nip N. One suitable mechanism for cooling the strip to achieve that amount of cooling is described in U.S. Pat. No. 4,823,860, incorporated herein by reference.

The strip casting method disclosed herein is especially suitable for aluminum alloy with high level of Mg. During casting, the molten metal goes through a converging channel therefore ensuring good contact with the rolls, and thus good heat transfer, at all times. This action eliminates the bleeding out of Mg from molten metal in the inner layers to the strip surface that would occur if heat transfer was lost. Another benefit is in-line hot rolling. The very high strip speeds of the caster allows for the rolling to be done with a minimum exposure of the cast strip to high temperatures. For a strip speed of 150 ft/min and a distance of 10 ft between the caster and the rolling mill, for example, the exposure time would be about 4 seconds, which is an insufficient period for any significant Mg bleed out from the solid strip by diffusion of Mg to the surface.

It is anticipated that other strip casting processes, such as twin belting casting (e.g., as described in U.S. Pat. No. 5,515,908, entitled "Method and apparatus for twin belt casting of strip" to Harrington, which is incorporated herein by reference in its entirety) could also be utilized to produce aluminum alloys having high amounts of magnesium, as described herein.

As noted above, the aluminum alloy products having a high amount of magnesium may also be produced via slab casting methods. Some methods of slab casting are described in U.S. Pat. No. 3,167,830, entitled "Continuous Metal casting Apparatus" to Hazelett, and U.S. Pat. No. 5,979,538, entitled "Continuous Chain Caster and Method"

to Braun et al, each of which is incorporated herein by reference in its entirety. The methods of these documents may require modification to account for the high amount of magnesium in the alloy, such as selection of high conductivity belts, cleaning of block surfaces and use of beryllium. Even with these modifications, Mg bleed out may still occur, and thus the strip casting processes described above are preferred.

Referring back now to FIG. 4*a*, after the aluminum alloy has exited the continuous casting apparatus, it is hot rolled (410), either in-line or off-line, via conventional techniques. "Hot rolling" means the mechanical reduction, at elevated temperature, of a continuously cast aluminum alloy to a sheet or plate product. In one embodiment, the aluminum alloy is hot rolled to a thickness of less than 6.35 mm (e.g., to assist in producing a sheet product). In one embodiment, the aluminum alloy is hot rolled to a thickness of at least 6.35 mm (e.g., to assist in producing a plate product). Preferred hot rolling temperature is dependent on the alloy. Alloys with moderately high Mg content (e.g., 6-7 wt. % Mg) may be rolled at temperatures as high as 900° F. Those containing a high Mg level (e.g., 8-10 wt. %), however, may require that the temperature of the strip be reduced before it enters the mill. For an alloy containing 8% Mg, for example, the mill entry temperature may be around 750° F.

Figure 4B:
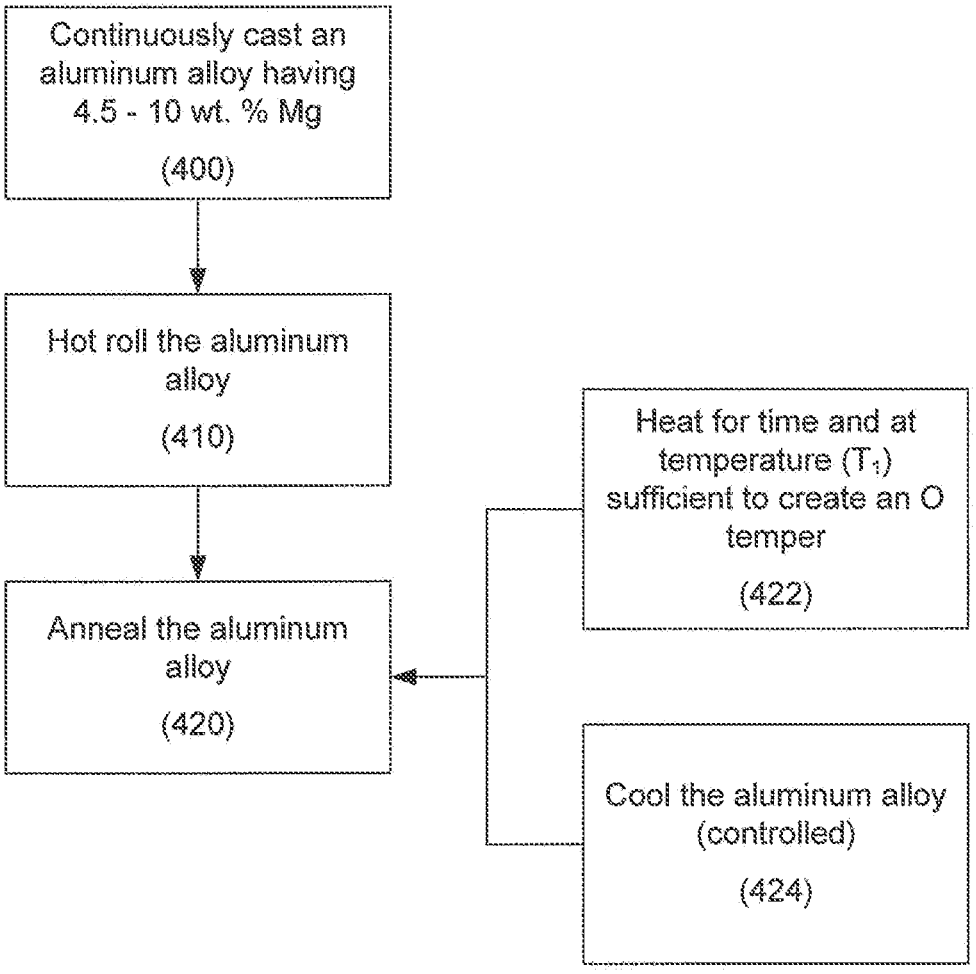
FIG. 4*b* is the flow chart of FIG. 4*a* including additional embodiments relating to the anneal step.

Referring now to FIG. 4*b*, the annealing step (420) at least partially assists in creating aluminum alloy products having a high amount of magnesium that are resistant to stress corrosion cracking and intergranular corrosion. The annealing step generally comprises at least two steps: heating the aluminum alloy at elevated temperature and for a time sufficient to achieve an O temper (422), and controlled cooling of the aluminum alloy (424). Generally, after the cooling step (424), the Al—Mg alloy comprises a plurality of grains, and the aluminum alloy is substantially free of a continuous film of β-phase at the grain boundaries. The aluminum alloy is also substantially free of a continuous film of β-phase at the grain boundaries after the Al—Mg alloy has been age sensitized (step not illustrated). As noted above, "age sensitized" means that the aluminum alloy has been artificially aged to a condition representative of at least 20 years of service life. For example, the aluminum alloy may be continuously exposed to elevated temperature for several days (e.g., a temperature in the range of about 100° C.-120° C. for a period of about 7 days).

With respect to the heating step (422), the aluminum alloy may be heated at any suitable temperature for any suitable period of time so long as the aluminum alloy achieves an O temper. "O temper" means an annealed temper as defined by The Aluminum Association. For example, and with respect to a strip cast or slab cast sheet product, the aluminum alloy may be heated to a temperature (T1), where T1 is in the range of 365° C. to about 500° C. When the temperature is in the range of T1, the heating period may be for a period of at least about 2 hours.

Figure 4C:
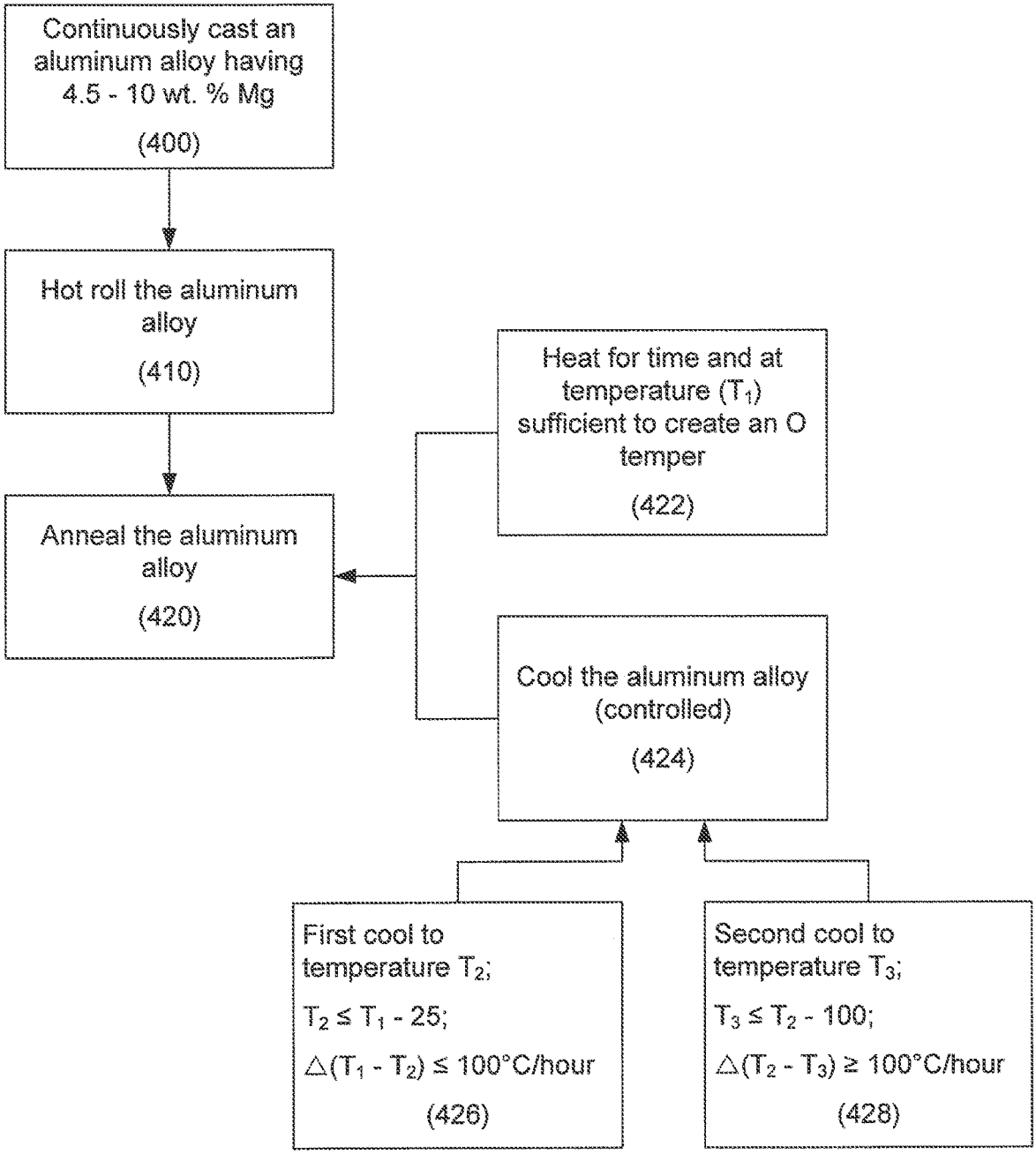
FIG. 4*c* is the flow chart of FIG. 4*b* including additional embodiments relating to the cooling step.

Referring now to FIG. 4*c*, the cooling step (424), generally includes two parts: a first slow cooling step (426) and a second faster cooling step (428). With respect to the first slow cooling step (426), the aluminum alloy is cooled from the heating temperature (e.g., T1) to a first cooler temperature (e.g., T2). Generally the first cooler temperature (T2) is at least about 25° C. less than the heating temperature (T1), and the rate of cooling from the heating temperature (T1) to the first cooler temperature (T2) is not greater than about 100° C. per hour, such as a rate of cooling in the range of from about 30° C./hour to about 60° C./hour.

With respect to the second faster cooling step (428), the aluminum alloy is cooled from the first cooler temperature (e.g., T2) to a second cooler temperature (e.g., T3). The second cooler temperature (T3) is generally at least about 100° C. less than the first cooler temperature (T2). The cooling rate of the second cooling step is generally at least about 100° C./hour.

An advantage of the instantly disclosed process is that the alloys do not require a separate, post-processing heat treatment, but are still resistant to stress corrosion cracking and intergranular corrosion. Thus, in one embodiment, a process for producing an aluminum alloy product is free of a heat treatment step.

The alloy may be further prepared according to conventional methodologies prior to use. For example, the alloy may be cleaned, stretched, leveled, slit, coated (e.g., by a lubricant or paint), as appropriate, and finally coiled.

EXAMPLES

Example 1—High Ma Cesium Alloy (6.4 wt. % Produced Via a Flash Anneal

An aluminum alloy consisting essentially of 6.4 wt. % Mg and 0.5 wt. % Zn, the balance being aluminum, incidental elements and impurities is strip cast. The strip cast alloys has a thickness of 3.4 mm and a width of 0.41 m. Coupons (0.75 m) are removed from the alloy and are allowed to cool to room temperature.

A first set of coupons ("Alloy 1") are subsequently reheated to 850° F. and are hot rolled until a nominal thickness of about 1 mm is reached. Alloy 1 is then subjected to flash anneal conditions. Specifically Alloy 1 is heated in a salt bath to 950° F. for 60 seconds, and then quenched by air jets at a rate of about 90° F./second.

A first sample of Alloy 1 (Alloy 1-a) is then age sensitized and then subjected to intergranular corrosion testing per ASTM G67-86. Another sample of Alloy 1 (Alloy 1-b) is age sensitized and then subjected to a forming and paint bake cycle, which involved a transverse stretch of about 5% followed by baking at 375° F. for 30 minutes, followed by intergranular corrosion testing per ASTM G67-86. Both the Alloys 1-a and 1-b fail the intergranular corrosion tests realizing a mass loss above 25 mg/cm$^2$. Specifically, Alloy 1-a realizes a mass loss of 30 mg/cm$^2$, and Alloy 1-b realizes a 61-70 mg/cm$^2$ mass loss.

Figure 7A:
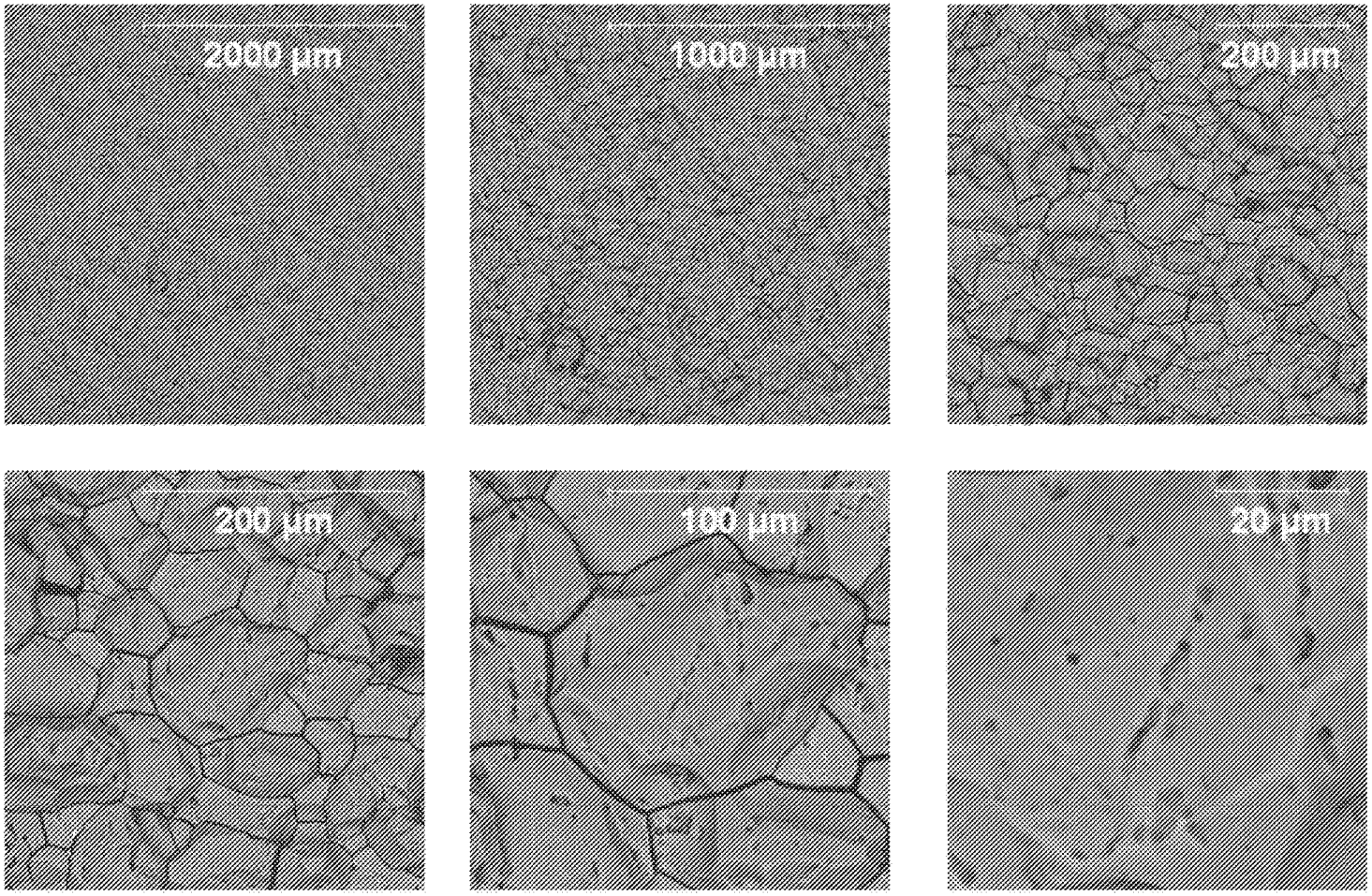
FIGS. 7*a*-7*d* are micrographs of an age sensitized, high-Mg alloy annealed according to a prior art flash anneal process and tested for intergranular corrosion.
Figure 7B:
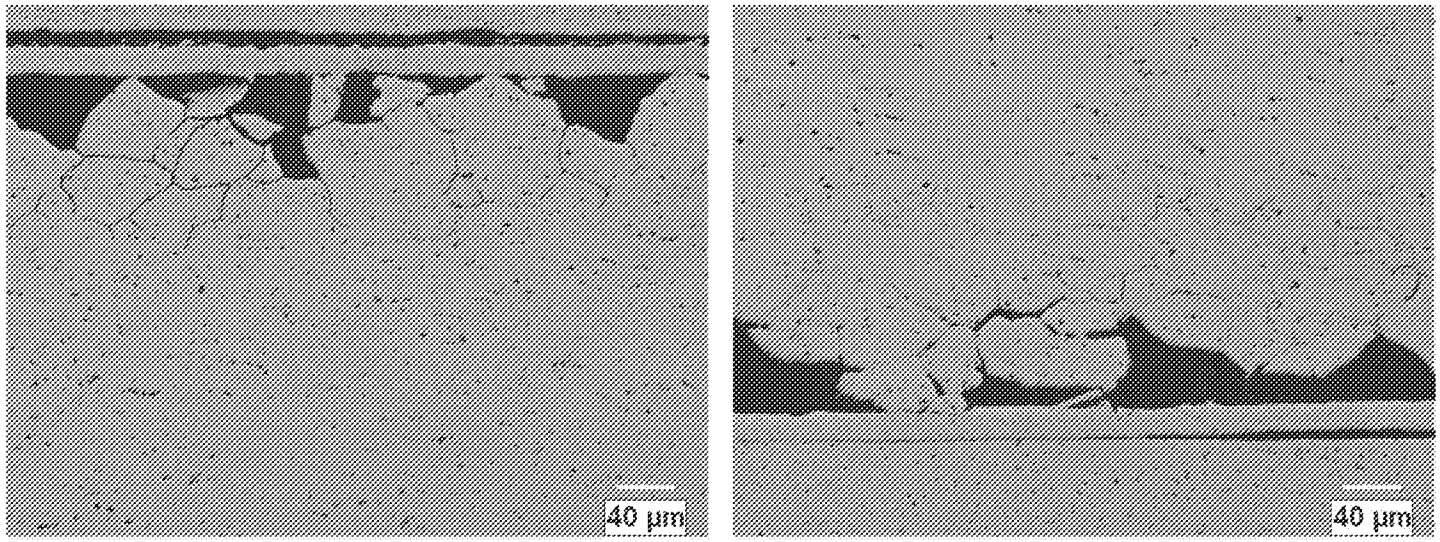
Figure 7C:
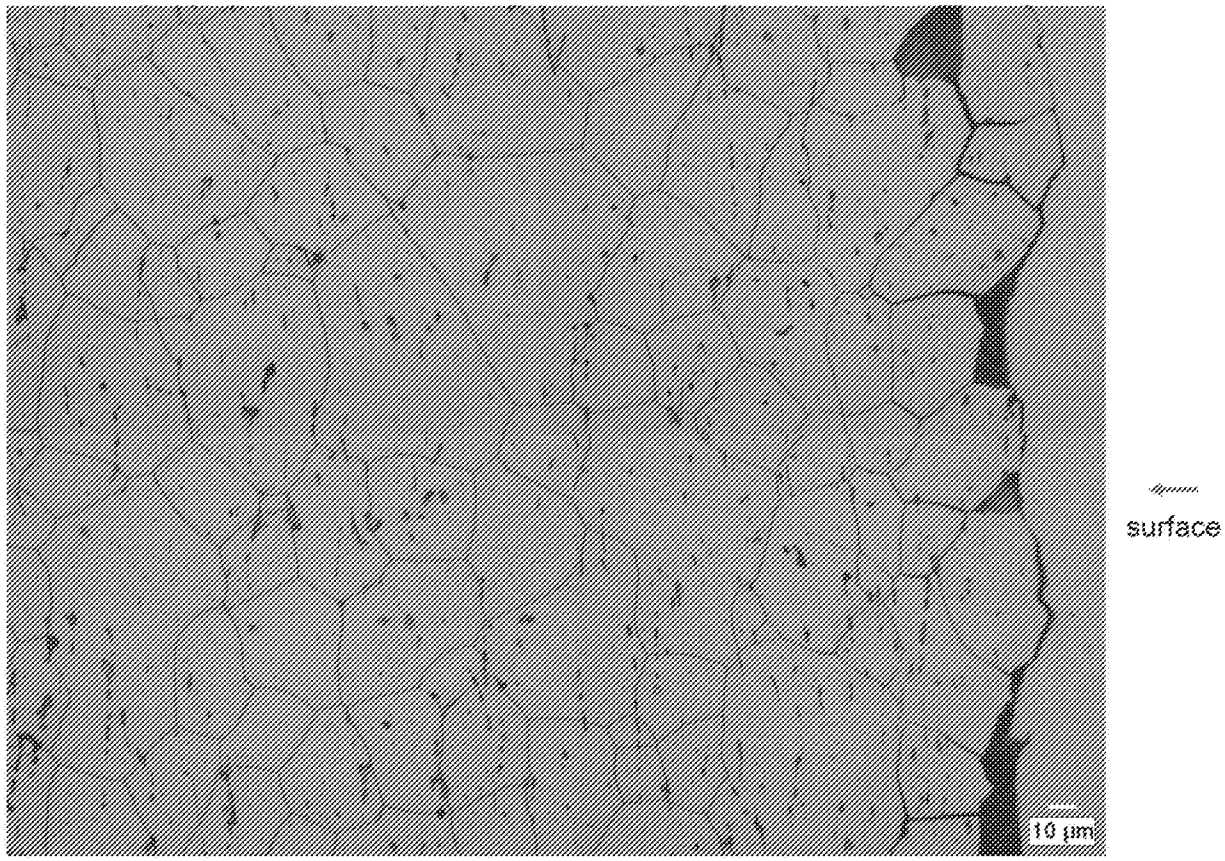
Figure 7D:
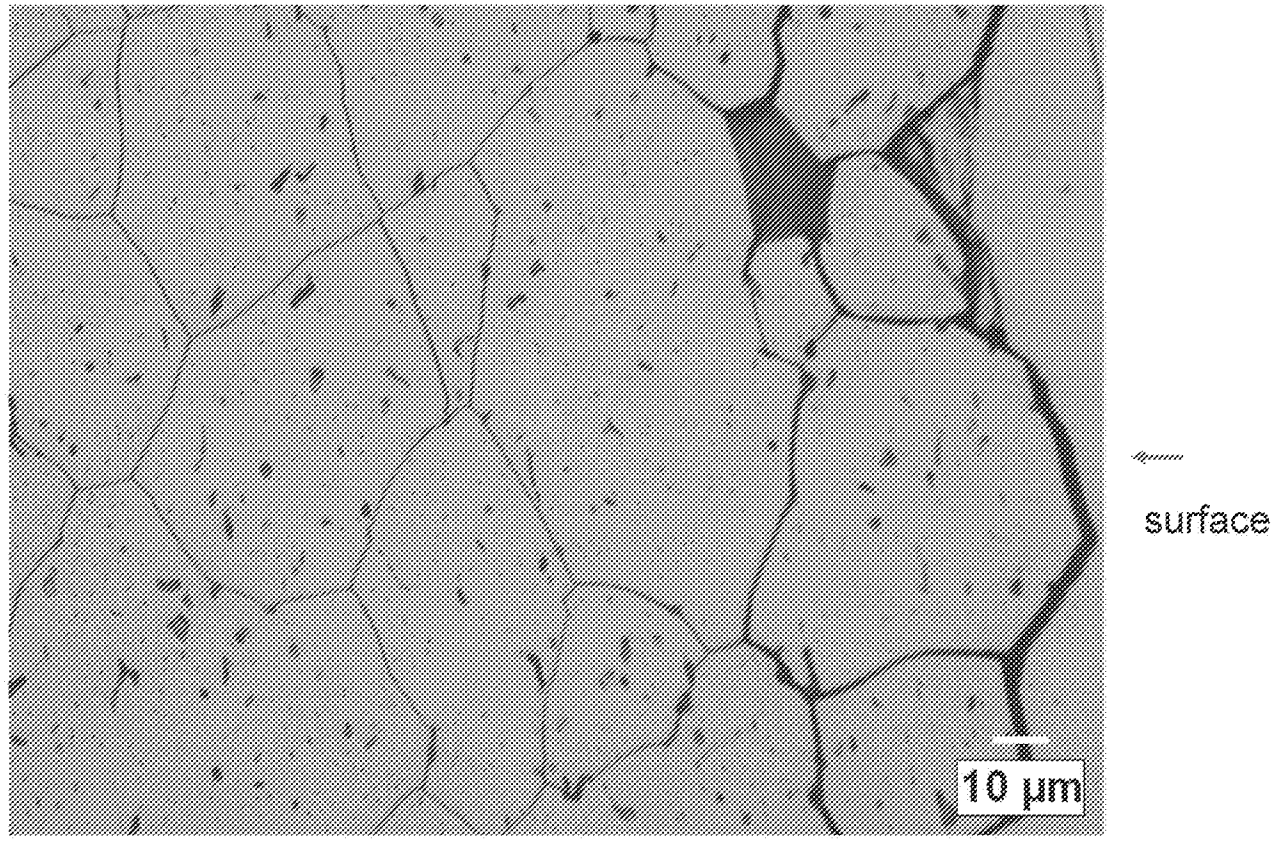

Selected samples of the age sensitized, stretched and painted alloy (Alloy 1-b) are examined prior to and after corrosion tests via SEM examination of the samples, internal examination by optical microscopy and SEM and phase identification of samples after mounting and metallographic preparation. This analysis reveals that the corrosive attack was primarily at the grain boundaries and at the constituent particles within grains (FIG. 7*a*). The latter form of attack causes dimples to form at those locations, which are several μm in size and in some cases aligned. The dimples covered only a small fraction of the grains. In cross sections (FIG. 7*b*) penetration was found to be 2-5 grains deep. Several layers of grains would have been lost during the test and the depth observed does not reflect the full depth of attack. This is apparent also from the thinner section, "sandy" feel of the surfaces, and the visual appearance of the corroded specimen. When grain boundaries are revealed by Graff-Sargent etching (FIGS. 7*c*-7*d*), they are found to contain a continuous film of uniform width in the submicron range (~0.1 μm). This film is likely to be the $Al_3Mg_2$ phase. This specimen showed a low density Mg; Si population. The average grain size of the specimen was ~50 μm and it was fully recrystallized.

This analysis reveals that the corrosive is the attack is primarily at the grain boundaries and at the constituent particles within grains. The latter form of attack caused dimples to form at those locations. These were several μm in size and in some cases aligned. The dimples covered only a small fraction of the grains. In cross sections, penetration was found to be 2-5 grains deep. It is noted that several layers of grains would have been lost during the test and the depth observed does not reflect the full depth of attack. This was apparent also from the thinner section, "sandy" feel of the surfaces, and the visual appearance of the corroded specimen. When grain boundaries were revealed by Graff-Sargent etching, they were found to contain a continuous film of uniform width in the submicron range (~0.1 μm). That film is likely to be the $Al_3Mg_2$ phase. The average grain size of the specimen was about 50 μm and it was fully recrystallized.

Example 2—High Magnesium Alloy (6.4 wt %) Produced Via Slow Cool

Another set of coupons (0.75 m) are removed from the alloy of Example 1 (i.e., the aluminum alloy consisting essentially of 6.4 wt. % Mg and 0.5 wt, % Zn, the balance being aluminum, incidental elements and impurities) and are allowed to cool to room temperature. This second set of coupons ("Alloy 2") are subsequently reheated to 850° F. and are hot rolled until a nominal thickness of about 1 mm is reached. Alloy 2 is then heated in a furnace to 850° F. and held for 4 hours. Next, Alloy 2 is allowed to cool in the furnace until the temperature fell to 400° F. over a period of 5.5 hours (an average cooling rate of 82° F. per hour). Next, the furnace was opened and further cooling to 200° F. occurred over an 1.5 hour period. This method represents a typical batch anneal in a furnace.

A first sample of Alloy 2 (Alloy 2-a) is then age sensitized and then subjected to intergranular corrosion testing per ASTM G67-86. Another sample of Alloy 2 (Alloy 2-b) is age sensitized and then subjected to a forming and paint bake cycle, which involved a transverse stretch of about 5% followed by baking at 375° F. for 30 minutes, followed by intergranular corrosion testing per ASTM G67-86. Both the Alloys 2-a and 2-b pass the intergranular corrosion tests realizing a mass loss of only 3 mg/cm$^2$ and 6 mg/cm$^2$, respectively.

Both Alloys 2-a and 2*b* also subjected to stress corrosion cracking (SCC) tests according to ASTM G44-88 after age sensitization. A stress level of 75% of yield strength in the L direction is selected for this test. Each test is done in triplicate, and for a total of 40 days. No SCC failures occurred of either Alloys 2-a or 2-b within the 40 day period. This high-Mg alloy is therefore resistant to both intergranular corrosion and stress corrosion cracking.

Figure 8A:
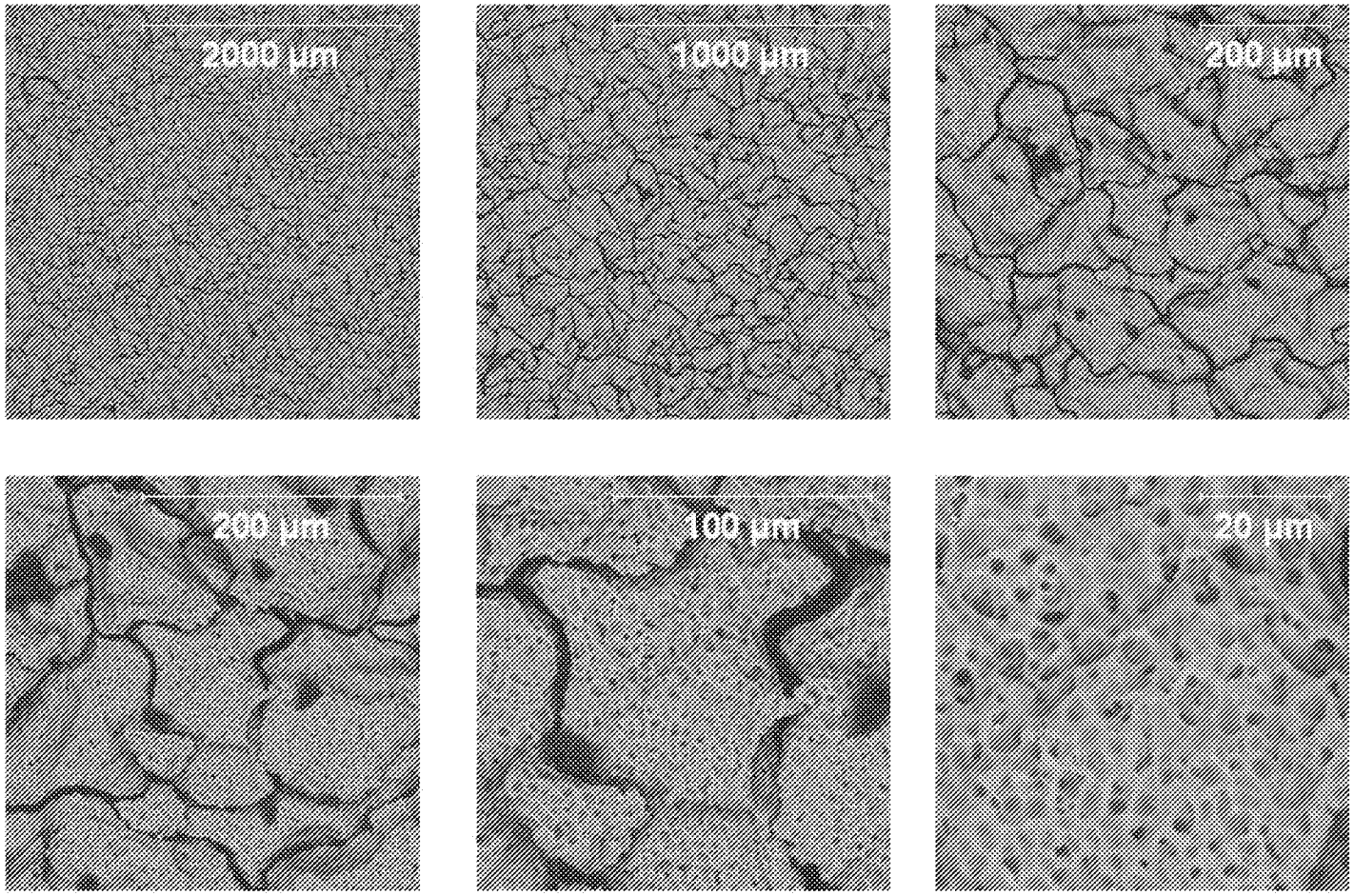
FIGS. 8*a*-8*b* are micrographs of an age sensitized high-Mg alloy produced according to one embodiment of an anneal process of the instant disclosure and tested for intergranular corrosion.
Figure 8B:
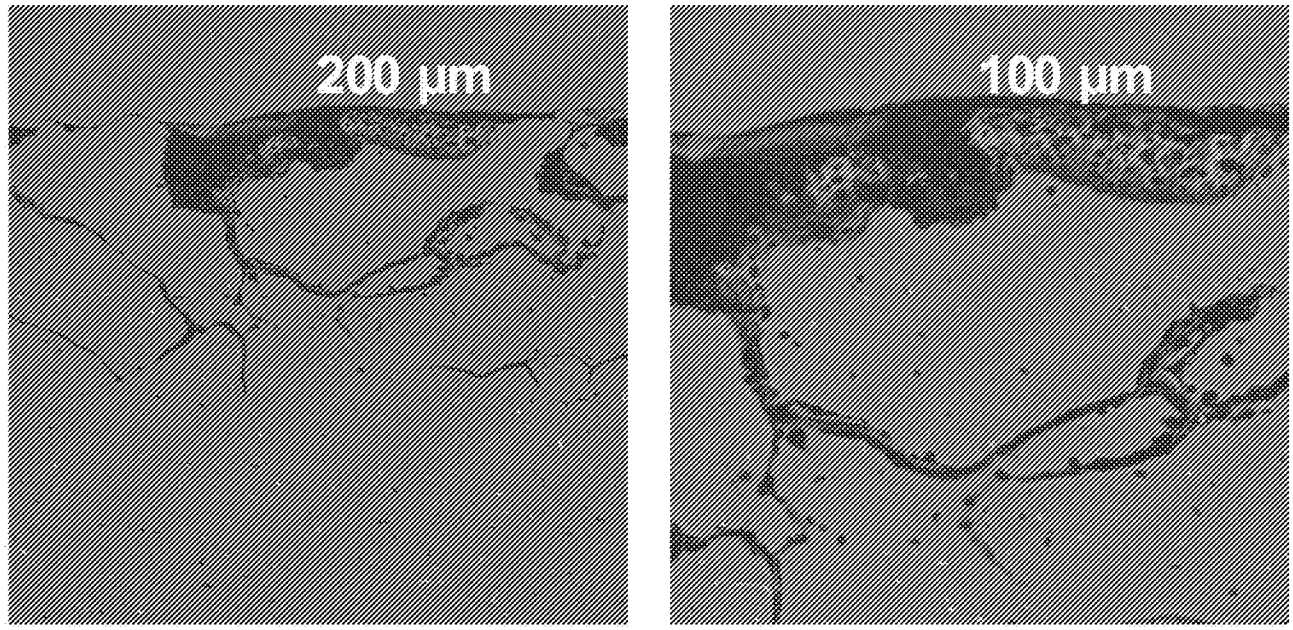

Selected samples of the age sensitized, stretched and painted alloy (Alloy 2-b) are examined prior to and after corrosion tests via SEM examination of the samples, internal examination by optical microscopy and SEM and phase identification of samples after mounting and metallographic preparation. This analysis reveals that the material showed a dimpled appearance in the grains and substantial opening of the grain boundaries (FIG. 8*a*). The dimples varied in size over a wide range with a typical diameter of ~5 μm. Corrosion within the specimen followed grain boundaries and opened up to expose a gap of similar size between grains. Penetration of corrosion from the grain boundaries into the grains also showed dimples. Depth of corrosion was limited to 2-3 grains from the surface (FIG. 8*b*). Internal attack started at grain boundaries and grew into the grains. This resulted in a gradually decreasing depth of penetration into grains along the path of attack. Under the optical microscope, the grain boundaries were found to be decorated by a discontinuous precipitate in a sub-micron size range (FIG. 3). Within grains, two constituent phases were noted—one was a fine precipitate ($Mg_2Si$), and the other a coarser particles of up to ~5 μm size that contained Fe (e.g., $Al_3Fe$ and $\alpha$-$Al_{12}Fe_3Si$). No phases were found that contained Zn, suggesting that it was in solution in the matrix. Grains in this sample did not show the sharp boundaries typical of the fully recrystallized structures. The average grain size was ~60 μm and this was unaffected by the corrosion test. It is postulated that a discontinuous β-phase is present at the grain boundaries based on the anneal conditions and the presence of isolated grain boundary precipitates.

Example 3—High Magnesium Alloy (8 wt. %) Produced Via Slow Cool

An aluminum alloy consisting essentially of 7.96 wt. % Mg and 0.032 wt. % Zn, the balance being aluminum, incidental elements and impurities is strip cast. The strip cast alloys has a thickness of 3.4 min and a width of 0.41 m. Coupons (0.75 m) are removed from the alloy and are allowed to cool to room temperature. The coupons ("Alloy 3") are subsequently reheated to 750° F. and are hot rolled until a nominal thickness of about 1 mm is reached. Alloy 3 is then processed according to the processing steps of Example 2.

Alloy 3 is then age sensitized and then subjected to intergranular corrosion testing per ASTM G67-86. Alloy 3 passes the intergranular corrosion tests realizing a mass loss of only 9.2 mg/cm'. Alloy 3 is subjected to stress corrosion cracking (SCC) tests according to ASTM G44-88 after age sensitization. A stress level of 75% of yield strength in the L direction is selected for this test. Each test is done in triplicate, and for a total of 40 days. No SCC failures occur for Alloy 3 within the 40 day period. This high-Mg alloy is therefore resistant to both intergranular corrosion and stress corrosion cracking.

While various embodiments of the present disclosure have been described in detail, it is apparent that modifications and adaptations of those embodiments will occur to those skilled in the art. However, it is to be expressly understood that such modifications and adaptations are within the spirit and scope of the present disclosure. Furthermore, the use of reference numerals in the claims and/or description are not intended to limit the claims and/or disclosure to any particular order or manner of operation, unless stated otherwise.

What is claimed is:

1. A continuously cast Al—Mg alloy sheet product comprising from 6 to 10 wt. % Mg, wherein the continuously cast Al—Mg alloy sheet product realizes a mass loss of less than 25 mg/cm$^2$ when tested per ASTM G67-86.

2. The continuously cast Al—Mg alloy sheet product of claim 1, wherein the Al—Mg alloy sheet product comprises a plurality of grains, wherein the grains have grain boundaries, and wherein the Al—Mg alloy sheet product is substantially free of a continuous film of β-phase at the grain boundaries.

3. The continuously cast Al—Mg alloy sheet product of claim 2, wherein the grains of the Al—Mg alloy sheet product comprise $Mg_2Si$ precipitates; and wherein the Al—Mg alloy sheet product comprises at least 0.5 volume percent of $Mg_2Si$ precipitates based on a volume of the Al—Mg alloy sheet product.

4. The continuously cast Al—Mg alloy sheet product of claim 1, wherein a thickness of the Al—Mg alloy sheet product is 0.25 inches or less.

5. The continuously cast Al—Mg alloy sheet product of claim 1, wherein the continuously cast Al—Mg alloy sheet product realizes a mass loss of less than 15 $mg/cm^2$ when tested per ASTM G67-86.

6. An automobile part comprising the continuously cast Al—Mg alloy sheet product of claim 1.

7. The continuously cast Al—Mg alloy sheet product of claim 1, wherein the continuously cast Al—Mg alloy sheet is resistant to stress corrosion cracking when tested per ASTM Standard G44-88.

8. The continuously cast Al—Mg alloy sheet product of claim 1, wherein the continuously cast Al—Mg alloy sheet product comprises from 6-7 wt. % Mg.

9. The continuously cast Al—Mg alloy sheet product of claim 1, wherein the continuously cast Al—Mg alloy sheet product comprises from 8-10 wt. % Mg.

10. The continuously cast Al—Mg alloy sheet product of claim 9, wherein the continuously cast Al—Mg alloy sheet is resistant to stress corrosion cracking when tested per ASTM Standard G44-88.

11. The continuously cast Al—Mg alloy sheet product of claim 1, wherein the sheet product comprises a top outer layer, a bottom outer layer, and an intermediate layer disposed between the top and bottom outer layers.

12. The continuously cast Al—Mg alloy sheet product of claim 11, wherein the top and bottom outer layers comprise equiaxed dendritic grains.

13. The continuously cast Al—Mg alloy sheet product of claim 12, wherein the intermediate layer comprises globular grains and eutectic between the grains.

14. The continuously cast Al—Mg alloy sheet product of claim 13, wherein the intermediate layer is absent of intermetallic particles.

* * * * *